US009278435B2

(12) United States Patent
Tsai

(10) Patent No.: US 9,278,435 B2
(45) Date of Patent: Mar. 8, 2016

(54) RATCHET SCREWDRIVER

(71) Applicant: Chiung-Chang Tsai, Taichung (TW)

(72) Inventor: Chiung-Chang Tsai, Taichung (TW)

( * ) Notice: Subject to any disclaimer, the term of this patent is extended or adjusted under 35 U.S.C. 154(b) by 246 days.

(21) Appl. No.: 14/073,848

(22) Filed: Nov. 6, 2013

(65) Prior Publication Data

US 2015/0122088 A1 May 7, 2015

(51) Int. Cl.
*B25B 15/04* (2006.01)
*B25B 23/00* (2006.01)
*B25B 13/46* (2006.01)

(52) U.S. Cl.
CPC ..... *B25B 15/04* (2013.01); *B25B 13/463* (2013.01); *B25B 13/468* (2013.01); *B25B 23/0007* (2013.01)

(58) Field of Classification Search
CPC .... B25B 13/46; B25B 13/463; B25B 13/468; B25B 15/04; B25B 23/0007
USPC ..... 81/62
See application file for complete search history.

(56) References Cited

U.S. PATENT DOCUMENTS

| | | | | |
|---|---|---|---|---|
| 6,925,912 | B2 * | 8/2005 | Huang | B25B 13/463 192/43.2 |
| 7,413,065 | B2 * | 8/2008 | Gauthier | B25B 13/463 192/43.1 |
| 7,926,391 | B2 * | 4/2011 | Hu | B25B 15/04 81/436 |
| 2012/0055290 | A1 * | 3/2012 | Chen | B25B 15/04 81/63.1 |

* cited by examiner

*Primary Examiner* — Hadi Shakeri

(57) ABSTRACT

A ratchet screwdriver includes a mounting seat, a fixing ring, a control member, a driving shaft, four pawls and four springs. The mounting seat has a space, two first slots and two second slots. A passage is defined through the mounting seat. The first slots each have a first hole and the second slots each have a second hole. The driving shaft has a ratchet portion located in the space. The four pawls are biased by the four springs so as to be engaged with the ratchet portion. The fixing ring is connected to the mounting seat and the four pawls are pivotably connected to the fixing ring. The control member is rotatably mounted to the mounting seat and the driving shaft. The control member has two control plates to pivot the pawls to disengage from the ratchet portion of the driving shaft.

3 Claims, 7 Drawing Sheets

RATCHET SCREWDRIVER

FIELD OF THE INVENTION

The present invention relates to a screwdriver, and more particularly, to a ratchet driving device for a ratchet screwdriver.

BACKGROUND OF THE INVENTION

U.S. Pat. No. 6,658,970 discloses a conventional ratchet screwdriver and comprises a mounting seat with multiple through holes which are defined radially therein and the actuating portions of the pawls are movably inserted into the through holes. There are circular holes defined axially in the front end of the mounting seat and the pivot ends of the pawls are engaged with the circular holes. It is noted that the assembling steps will be a time-consuming task because the pawls are inserted into the radial through holes and the axial circular holes. Especially for that the pivot end of each pawl is located at the middle portion of the top and bottom of the pawl, and the recess-conflicting wall of the tubular sleeve and the springs are respectively in contact the two opposite ends of the pawl, so that the pawl is pivoted about the pivot end. The pawl has to be made to large and this increases the size of the driving device of the screwdriver. Besides, the recess-conflicting walls of the tubular sleeve and the springs are respectively in contact the two opposite ends of the pawl so as to control the direction of the pawl, this will cause that driving direction to be unstable.

The present invention intends to provide a ratchet driving device for a ratchet screwdriver to improve the shortcomings mentioned above.

SUMMARY OF THE INVENTION

The present invention relates to a ratchet screwdriver and comprises a mounting seat, a fixing ring, a control member, a driving shaft, four pawls, four springs, a fixing ring, a control member, a bead, a positioning spring, a C-clip and a clipping member. The mounting seat has a space, a first slot and a second slot. A passage is defined through the mounting seat. The first slots each have a first hole and the second slots each have a second hole. The mounting seat has two fixing members and four fixing slots. A block extends from the outer periphery of the mounting seat. The driving shaft has a ratchet portion located in the space, and a section which is rotatably located in the passage. A groove is defined in the outer periphery of the section. The driving shaft has a working end at the front end thereof and an annular groove is defined in the outer periphery of the driving shaft. The pawls in the second slots have a bottom insertion inserted in the second holes. The four pawls are located in the first and second slots so as to bias the four springs to be engaged with the ratchet portion. The fixing ring is connected to the mounting seat and has four through holes, two apertures and four protrusions. The top insertions of the four pawls are pivotably inserted into the four holes. The two fixing members are inserted into the two apertures. The four protrusions are engaged with the four fixing slots. The control member is rotatably mounted to the mounting seat and has a mounting hole through which the driving shaft rotatably extends. The control plates extend from the inner periphery of the mounting hole. The control member has three positioning slots and a restriction slot defined therein. The block is movable in the restriction slot. The bead is axially and movably located in the reception hole. The positioning spring is located in the reception hole to bias the bead.

The C-clip is engaged with the groove of the driving shaft. The clipping member is engaged with the annular slot of the driving shaft.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
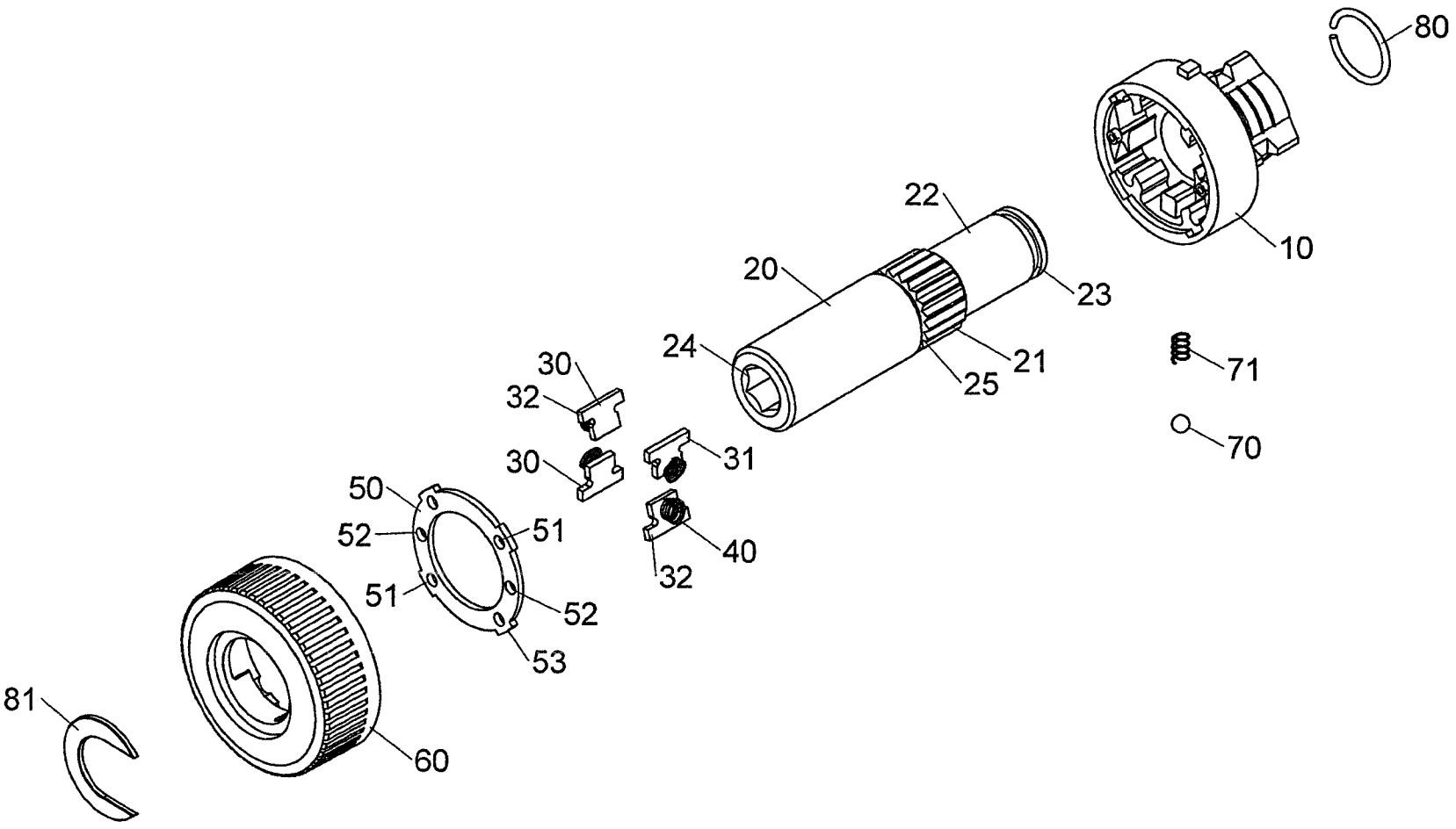
FIG. 1 is an exploded view of the ratchet screwdriver of the present invention.
Figure 3:
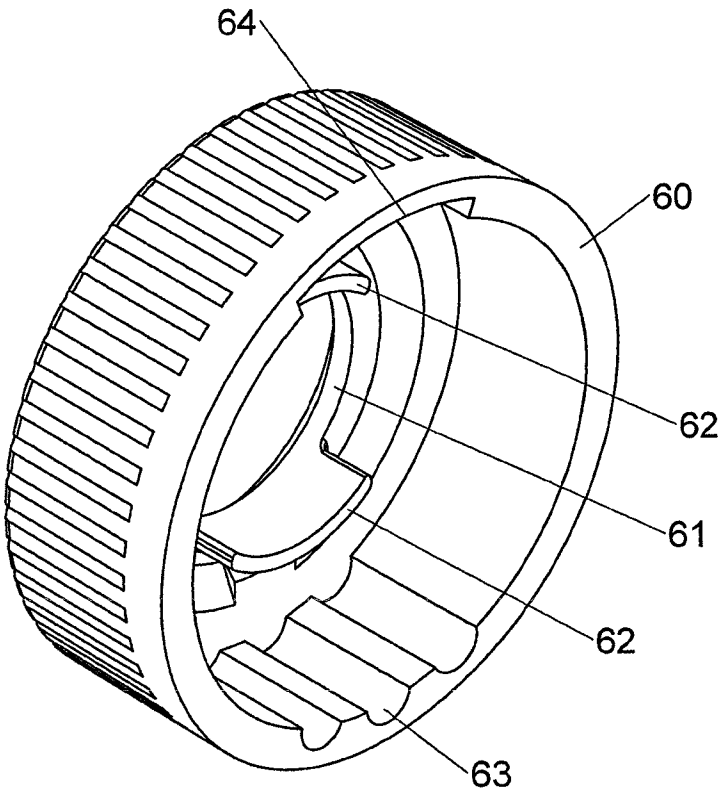
FIG. 3 is a perspective view to show the rear side of the control member of the ratchet screwdriver of the present invention.
Figure 2:
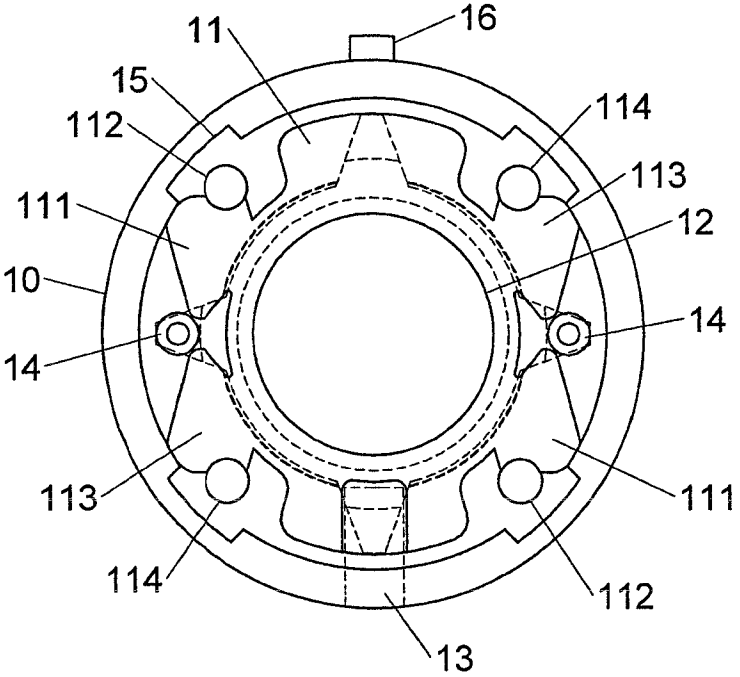
FIG. 2 is a plan view to show the front side of the mounting seat of the ratchet screwdriver of the present invention.
Figure 4:
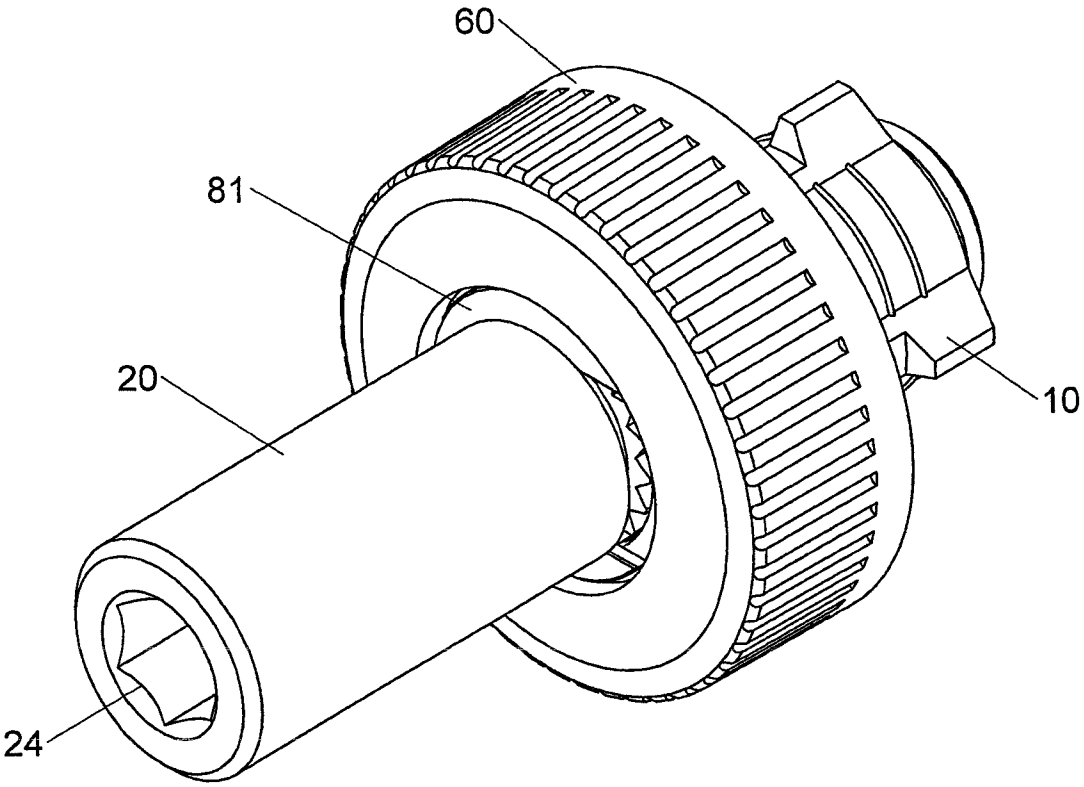
FIG. 4 is a perspective view to show the ratchet screwdriver of the present invention.
Figure 6:
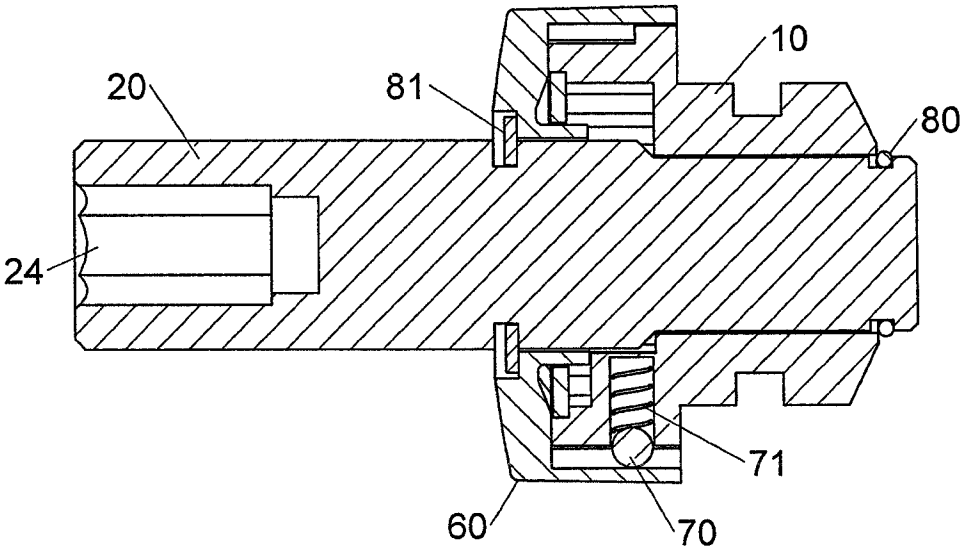
FIG. 6 is a cross sectional view taken along line B-B in FIG. 5.
Figure 5:
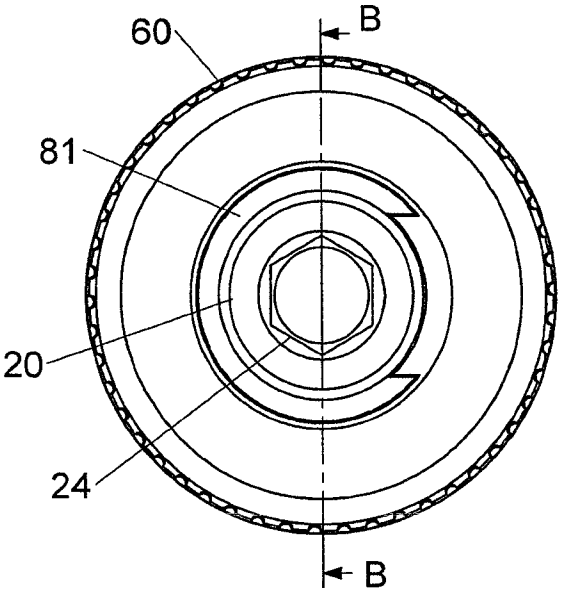
FIG. 5 is a front end view of the ratchet screwdriver of the present invention.

Referring to FIGS. 1 to 8, the ratchet screwdriver of the present invention comprises a mounting seat 10, a driving shaft 20, four pawls 30, four springs 40, a fixing ring 50, a control member 60, a bead 70, a positioning spring 71, a C-clip 80 and a clipping member 81. The rear side of the mounting seat 10 is connected with a handle (not shown) and has a space 11 defined in the front side thereof. Two first slot 111 and two second slots 113 are defined in the inside of the space 11. The first and second slots 111, 113 are located symmetrically in opposite directions to each other. Each of the first slots 111 has a first hole 112 defined in the inner portion thereof, and each of the second slots 113 has a second hole 114 defined in the inner portion thereof. A passage 12 is defined through the mounting seat 10 and has a smaller diameter. A reception hole 13 is defined in the wall of the mounting seat 10. The mounting seat 10 has two fixing members 14 and four fixing slots 15 defined in the front side thereof. A block 16 extends from the outside of the mounting seat 10 and located in opposite to the reception hole 13.

The driving shaft 20 has a ratchet portion 21 which has a larger outer diameter and is located in the space 11. The ratchet portion 21 has multiple teeth and concavities which are located alternatively to the teeth. A section 22 with a smaller diameter extends from the rear end of the driving shaft 20 and is rotatably inserted through the passage 12. A groove 23 is defined in the outer periphery of the rear end of the section 22 and located beyond the mounting seat 10. A working end 24 is formed on the front end of the driving shaft 20 and has a polygonal recess such as a rectangular recess or a hexagonal recess, so as to be connected with a driving member, a bolt, a nut, a socket or a connection rod. An annular slot 25 is defined in the outer periphery of the driving shaft 20.

Four pawls 30 are respectively located in the first and second slots 111, 113, and each pawl 30 has a bottom insertion 31 and a top insertion 32 extending from two ends of one side thereof. The bottom insertions 31 of the pawls 30 in the first slots 111 are pivotably inserted into the first holes 112 so that each of the pawls 30 is pivotable to engage the other side thereof with one of the concavities of the ratchet portion 21. Therefore, the driving shaft 20 is driven to rotate counter clockwise by rotating the mounting seat 10 by the engagement between the pawls 30 in the first slots 111 and the ratchet portion 21 of the driving shaft 20. The bottom insertions 31 of the pawls 30 in the second slots 113 are pivotably inserted into the second holes 114 so that each of the pawls 30 is pivotable to engage the other side thereof with one of the concavities of the ratchet portion 21. Therefore, the driving shaft 20 is driven to rotate clockwise by rotating the mounting seat 10 by the engagement between the pawls 30 in the second slots 113 and the ratchet portion 21 of the driving shaft 20.

Four springs 40 are respectively located in the two first slots 111 and the two second slots 113 and provide a force to pivot the pawls 30 to engage with the ratchet portion 21. The springs 40 in the first slots 111 each are biased between the inside of the first slot 111 and the pawl 30 corresponding thereto, and the springs 40 in the second slots 113 each are biased between the inside of the second slot 113 and the pawl 30 corresponding thereto. By the force from the springs 40, the four pawls 30 are pivoted and engaged with the concavities of the ratchet portion 21.

When the driving shaft 20 is rotated counter clockwise, the teeth of the ratchet portion 21 drive the pawls 30 in the first slots 111 to compress the springs 40 on respective insides of the pawls 30 so that the driving shaft 20 is freely rotated. When the driving shaft 20 is rotated clockwise, the teeth of the ratchet portion 21 drive the pawls 30 in the second slots 113 to compress the springs 40 on respective insides of the pawls 30 so that the driving shaft 20 is freely rotated.

The fixing ring 50 is a ring-shaped member and is connected to the front side of the mounting seat 10, and has four through holes 51, two apertures 52 and four protrusions 53. The top insertions 32 of the four pawls 30 are pivotably inserted into the four through holes 51. The two fixing members 14 are inserted into the two apertures 52. The four protrusions 53 are engaged with the four fixing slots 15.

The control member 60 is rotatably mounted to the mounting seat 10 and has a mounting hole 61 defined therethrough and the driving shaft 20 rotatably extends through the mounting hole 61. Two control plates 62 symmetrically extend from the inner periphery of the mounting hole 61. When the control member 60 is rotated clockwise, the two control plates 62 pivot the two pawls 30 in the second slots 113 to compress the springs 40 and remove the two pawls 30 in the second slots 113 from the concavities of the ratchet portion 21, so that the driving shaft 20 is freely rotated counter clockwise relative to the mounting seat 10.

When the control member 60 is rotated counter clockwise, the two control plates 62 pivot the two pawls 30 in the first slots 111 to compress the springs 40 and remove the two pawls 30 in the first slots 111 from the concavities of the ratchet portion 21, so that the driving shaft 20 is freely rotated clockwise relative to the mounting seat 10. The control member 60 has three positioning slots 63 and a restriction slot 64 defined therein. The block 16 is movable in the restriction slot 64. When the block 16 contacts one end of the restriction slot 64, the two control plates 62 remove the two pawls 30 in the first slots 111 from the concavities of the ratchet portion 21. When the block 16 contacts the other end of the restriction slot 64, the two control plates 62 remove the two pawls 30 in the second slots 113 from the concavities of the ratchet portion 21. The bead 70 is axially and movably located in the reception hole 13. The positioning spring 71 is located in the reception hole 13 and biases the bead 70 outward to be engaged with one of the positioning slots 63, so as to position the control member 60 at a first position where the driving shaft 20 is freely rotated counter clockwise, a second position where the driving shaft 20 cannot rotate freely, and a third position where the driving shaft 20 is freely rotated clockwise.

The C-clip 80 is engaged with the groove 23 of the driving shaft 20 and restricts the driving shaft 20 from being separated from the front side of the mounting seat 10. The clipping member 81 is engaged with the annular slot 25 of the driving shaft 20 to restrict the control member 60 from being separated from the front side of the mounting seat 10.

Figure 7:
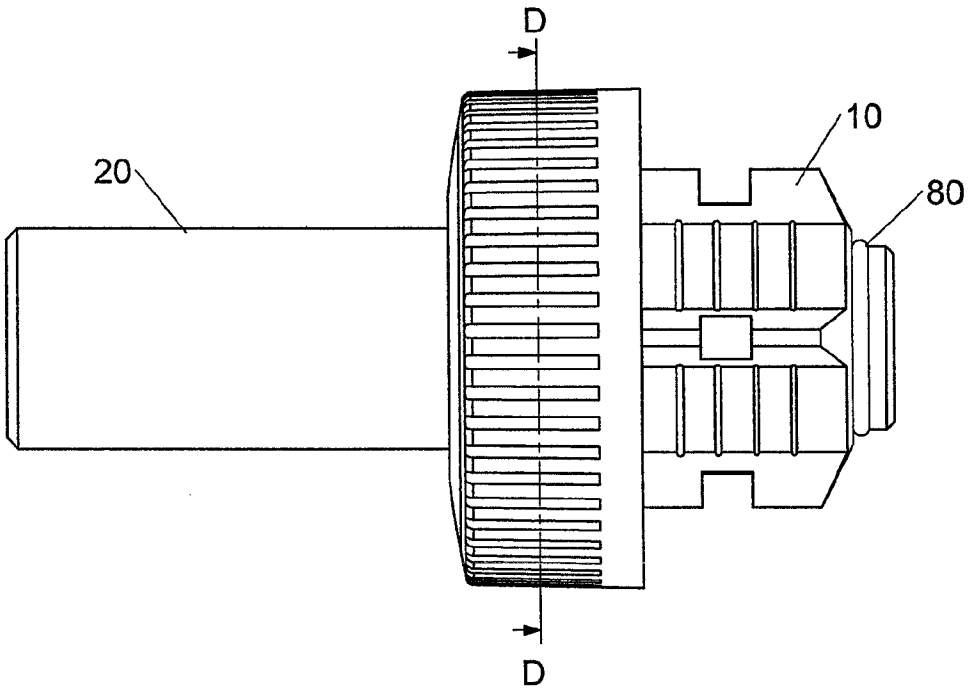
FIG. 7 is a side view of the ratchet screwdriver of the present invention.
Figure 8:
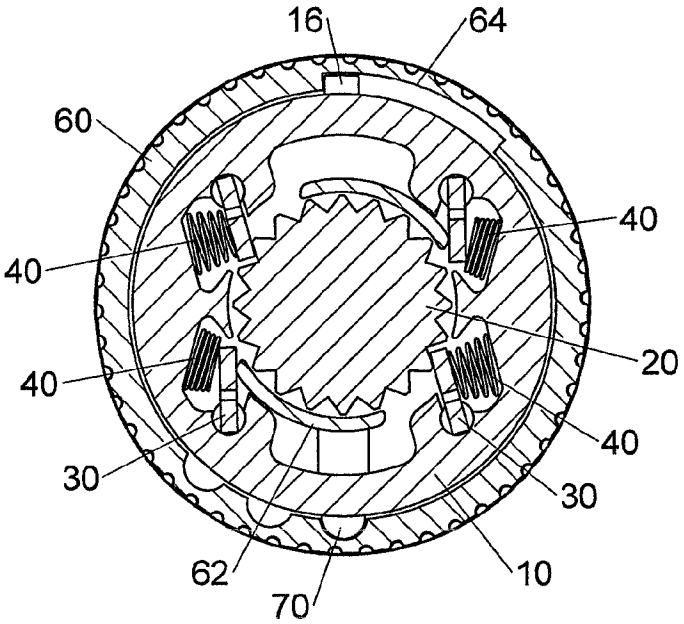
FIG. 8 is a cross sectional view taken along line D-D in FIG. 7.

As shown in FIGS. 7 and 8, when the control member 60 is rotated clockwise relative to the mounting seat 10, and the block 16 moves and contacts the other end of the restriction slot 64, the bead 70 is engaged with the positioning slot 63 to position the control member 60. The control plates 62 remove the two pawls 30 in the second slots 113 from the concavities of the ratchet portion 21. Therefore, when the mounting seat 10 is rotated clockwise, the two pawls 30 in the first slots 111 drive the driving shaft 20 to rotate clockwise. When the mounting seat 10 is rotated counter clockwise, the driving shaft 20 is freely rotated in the mounting seat 10.

Figure 9:
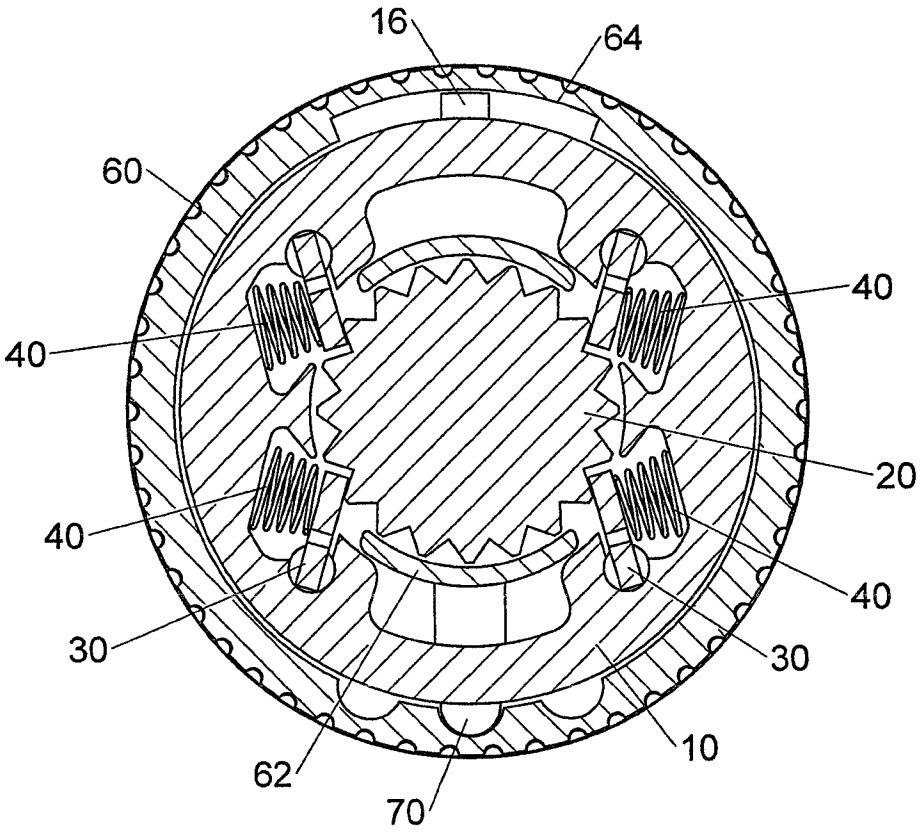
FIG. 9 shows the restricted status of the ratchet screwdriver of the present invention.

As shown in FIG. 9, when the control member 60 is rotated relative to the mounting seat 10 to let the bead 70 engaged with the positioning slot 63, the two ends of the two control plates 62 do not pivot the pawls 30 so that the pawls 30 are biased by the springs 40 and pivoted to be engaged with the concavities of the ratchet portion 21. Therefore, when the mounting seat 10 is rotated clockwise, the two pawls 30 in the first slots 111 drive the driving shaft 20 to rotate clockwise. When the mounting seat 10 is rotated counter clockwise, the driving shaft 20 is rotated in counter clockwise by the pawls 30 in the second slots 113.

Figure 10:
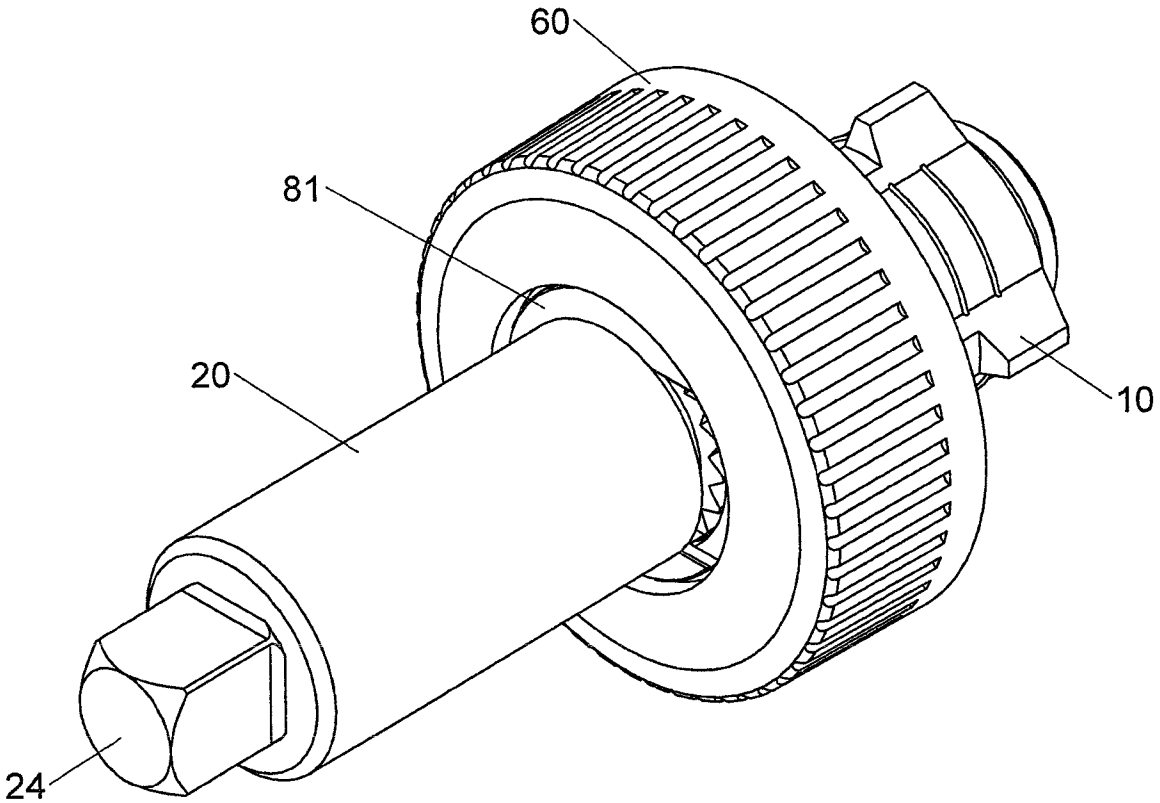
FIG. 10 shows another embodiment of the ratchet screwdriver of the present invention.

As shown in FIG. 10 which shows the second embodiment of the present invention wherein the difference is that the working end 24 of the driving shaft 20 has a polygonal rod which can be connected with a socket or a bolt, or a threaded member connected with a rectangular rod or hexagonal rod.

The advantages of the present invention are that the first and second slots 111, 113 for receiving the pawls 30 are defied in the inside of the space 11 and they open toward the space 11, and the first and second holes 112, 114 for the bottom insertions 31 are located directly at the lower end of the first and second slots 111, 113, so that the pawls 30 and the springs 40 are easily installed to the first and second slots 111, 113, and the first and second holes 112, 114. They are oriented in the same direction. The top and bottom insertions 32, 31 of the pawls 30 allow the pawls 30 to be easily pivoted so as to engage the other side of the pawls 30 with the concavities of the ratchet portion 21 to control the direction of the driving shaft 20. Therefore, the pawls 30 can be made smaller and shorter, and this also allows the driving device to have smaller volume and shorter diameter. The control plates 62 of the control member 60 for pivoting the pawls 30 are located on the opposite sides to the springs 40, so that the actions can be more precise and efficient.

While we have shown and described the embodiment in accordance with the present invention, it should be clear to those skilled in the art that further embodiments may be made without departing from the scope of the present invention.

What is claimed is:

1. A ratchet screwdriver comprising:

a mounting seat having a space defined in a front side thereof, two first slot and two second slots defined in an inside of the space, the first and second slots located symmetrically in opposite directions to each other, each of the first slots having a first hole defined in an inner portion thereof, each of the second slots having a second hole defined in an inner portion thereof, a passage defined through the mounting seat, a reception hole defined in a wall of the mounting seat, the mounting seat having two fixing members and four fixing slots defined in the front side thereof, a block extending from an outside of the mounting seat and located in opposite to the reception hole;

a driving shaft having a ratchet portion which is located in the space, the ratchet portion having multiple teeth and concavities which are located alternatively to the teeth, a section extending from a rear end of the driving shaft and rotatably inserted through the passage, a groove defined in an outer periphery of a rear end of the section and located beyond the mounting seat, a working end formed on a front end of the driving shaft and adapted to be connected with a driving member, an annular slot defined in the outer periphery of the driving shaft;

four pawls respectively located in the first and second slots, each pawl having a bottom insertion and a top insertion extending from two ends of one side thereof, the bottom insertions of the pawls in the first slots pivotably inserted into the first holes so that each of the pawls is pivoable to engage the other side thereof with one of the concavities of the ratchet portion, the driving shaft being driven to rotate counter clockwise by rotating the mounting seat by engagement between the pawls in the first slots and the ratchet portion of the driving shaft, the bottom insertions of the pawls in the second slots pivotably inserted into the second holes so that each of the pawls is pivoable to engage the other side thereof with one of the concavities of the ratchet portion, the driving shaft being driven to rotate clockwise by rotating the mounting seat by engagement between the pawls in the second slots and the ratchet portion of the driving shaft;

four springs respectively located in the two first slots and the two second slots and providing a force to pivot the pawls to engage with the ratchet portion, when the driving shaft is rotated counter clockwise, the teeth of the ratchet portion drive the pawls in the first slots to compress the springs on respective insides of the pawls so that the driving shaft is freely rotated;

a fixing ring connected to the front side of the mounting seat and having four through holes, two apertures and four protrusions, the top insertions of the four pawls pivotably inserted into the four through holes, the two fixing members inserted into the two apertures, the four protrusions engaged with the four fixing slots;

a control member rotatably mounted to the mounting seat and having a mounting hole defined therethrough and the driving shaft rotatably extending through the mounting hole, two control plates extending from an inner periphery of the mounting hole, when the control member is rotated clockwise, the two control plates drive the two pawls in the second slots to remove the two pawls in the second slots from the concavities of the ratchet portion, so that the driving shaft is freely rotated counter clockwise relative to the mounting seat, when the control member is rotated counter clockwise, the two control plates drive the two pawls in the first slots to remove the two pawls in the first slots from the concavities of the ratchet portion, so that the driving shaft is freely rotated clockwise relative to the mounting seat, the control member having three positioning slots and a restriction slot defined therein, the block being movable in the restriction slot, when the block contacts one end of the restriction slot, the two control plates remove the two pawls in the first slots from the concavities of the ratchet portion, when the block contacts the other end of the restriction slot, the two control plates remove the two pawls in the second slots from the concavities of the ratchet portion;

a bead axially and movably located in the reception hole;

a positioning spring located in the reception hole and biasing the bead outward to be engaged with one of the positioning slots, so as to position the control member at a first position where the driving shaft is freely rotated counter clockwise, a second position where the driving shaft cannot rotate freely, and a third position where the driving shaft is freely rotated clockwise;

a C-clip engaged with the groove of the section and restricting the driving shaft from being separated from the front side of the mounting seat, and a clipping member engaged with the annular slot of the driving shaft to restrict the control member from being separated from the front side of the mounting seat.

2. The ratchet screwdriver as claimed in claim 1, wherein the working end of the driving shaft has a polygonal recess.

3. The ratchet screwdriver as claimed in claim 1, wherein the working end of the driving shaft has a polygonal rod.

* * * * *